United States Patent [19]

Ando et al.

[11] 4,306,801

[45] Dec. 22, 1981

[54] CHARGING PROCESS FOR IMAGE FORMING APPARATUS

[75] Inventors: Yujiro Ando, Yokohama; Hidetoshi Tanaka, Musashino, both of Japan

[73] Assignee: Canon Kabushiki Kaisha, Tokyo, Japan

[21] Appl. No.: 97,865

[22] Filed: Nov. 27, 1979

[30] Foreign Application Priority Data

Dec. 6, 1978 [JP] Japan ..... 53-151386

[51] Int. Cl.[3] ..... G03G 15/00

[52] U.S. Cl. ..... 355/3 CH; 355/14 CH; 355/77

[58] Field of Search ..... 355/14 CH, 3 SC, 3 CH, 355/77; 430/31, 35

[56] References Cited

U.S. PATENT DOCUMENTS 4,044,671 8/1977 Holl et al. ..... 355/3 SC

*Primary Examiner*—Richard L. Moses

*Attorney, Agent, or Firm*—Fitzpatrick, Cella, Harper & Scinto

[57] ABSTRACT

The present invention relates to an electrostatic charging process for uniformly charging an image holding member such as a photoconductive or insulating drum. In an image forming apparatus in which such image holding member is driven both at a first speed and at a second speed different from said first speed, there results a phenomenon of uneven charging due to the difference between the start-up characteristic of charging performance of the charging means and the actual speed at the speed change-over of the image holding member. This drawback is prevented by the present invention in which the speed change-over time of the image holding member is selected different from the charging start time of the charging means in such a manner that the charging is initiated after the speed change-over.

6 Claims, 4 Drawing Figures

CHARGING PROCESS FOR IMAGE FORMING APPARATUS

BACKGROUND OF THE INVENTION

1. Field of the Invention

The present invention relates to a process for uniformly charging an image holding member, and more particularly to a process for performing, in an image forming apparatus comprising an image holding member to be driven at two different speeds, the electrostatic charging of said image holding member in relation to the speed thereof, thereby realizing a uniform potential thereon. Said image holding member includes a photosensitive drum, an insulating drum, a transfer sheet material, a recording sheet material etc.

2. Description of the Prior Art

An image forming apparatus comprising an image holding member to be driven at two different speeds is already known and disclosed for example in the U.S. Pat. No. 4,044,671. In such apparatus the image holding member, for example composed of a photosensitive drum, is rotated at a first speed in the step of forming a first latent image thereon, while it is driven at a second speed at a subsequent step of transferring said first latent image onto another member or of forming a second latent image corresponding to said first latent image on another member by means of ion modulation, thereby obtaining a reproduced image.

In case a corona discharger is employed for obtaining a uniform potential on an image holding member having a changeable speed as explained above, there is proposed a process of changing the intensity of corona discharge in response to the speed of said image holding member in order to prevent significant fluctuation in the charged potential resulting from the speed change. However if the discharge intensity of the corona discharger is changed simultaneously with the speed change-over as has been usually conducted, there will result an abnormally charged portion in the boundary area of said change-over (area located directly under the discharger at said change-over) even if the discharge intensity is maintained constant after said change-over. Such abnormally charged portion becomes visible on the final image or results in an unnecessary carry-over of the developer material.

The analysis on this drawback has revealed that it is generated from the difference between the start-up speed state of the image holding member and the start-up state of the change of corona discharge. More specifically the image holding member, which is mechanically accelerated or decelerated from the first speed to the second for example by the change of motor pole number or by a transmission, will receive excessive or deficient corona discharge, the intensity of corona discharge is increased or decreased before the speed of the image holding member is stabilized to the new value, until said speed is thus stabilized.

SUMMARY OF THE INVENTION

The object of the present invention is to provide an improvement over the above-explained drawback of the conventional process, said improvement more specifically being featured in reducing the change in the charged potential on the image holding member even in case of speed change-over during the latent image formation on said member thereby preventing the uneven contrast resulting from the potential change and thus assuring satisfactory image formation.

The above-mentioned object is achieved according to the present invention in an image forming apparatus in which the image holding member is to be driven at a first speed and a second speed, by performing, in response to the change-over from the first speed to the second speed of said image holding member, either (a) the start of charging operation by the charging means onto the image area of the image holding member, or (b) the end of said charging operation, or (c) the change of the charging ability of said charging means after said change-over of speed thereby realizing a uniform potential on said image holding member. The above-mentioned change-over of speed includes the change to a higher speed and that to a lower speed. The above-mentioned potential control is achieved by the change of voltage or current supplied to said corona discharger.

For example in an apparatus in which the speed of the image holding member is changed to a larger value, the above-mentioned object is achieved by increasing the intensity of corona discharge of the corona discharge means later than the speed increase of the image holding member. Also the above-mentioned object is achieved even when said intensity increase of corona discharge is made simultaneously with the speed change-over if the voltage supplied to the corona discharger is regulated in such a manner that the start-up characteristic of corona discharge coincides with that of the speed.

DESCRIPTION OF THE PREFERRED EMBODIMENTS

The present invention will now be explained in detail by the embodiments thereof.

Figure 1:
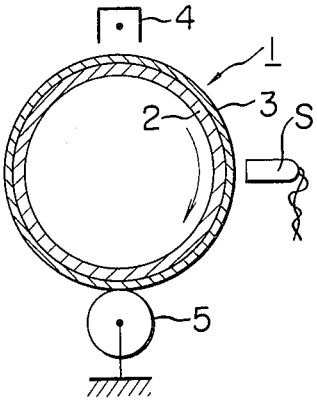
FIG. 1 is a schematic cross-sectional view of an experimental apparatus.
Figure 2:
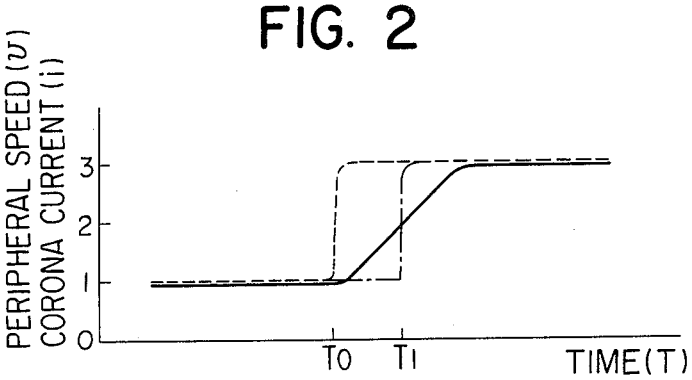
FIG. 2 is a chart showing the change of peripheral speed of the photosensitive drum shown in FIG. 1 and of the surface potential thereof as a function of time.
Figure 3:
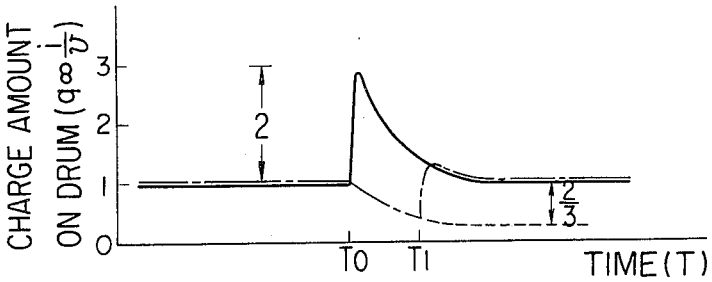
FIG. 3 is a chart showing the change of surface potential on said drum as a function of time.

FIG. 1 shows the working principle of the process of the present invention, and FIGS. 2 and 3 show the experimental results obtained in the apparatus shown in FIG. 1.

In FIG. 1, 1 is a photosensitive member functioning as the image holding member and composed of a Carlson-type two-layered photosensitive member comprising a conductive layer 2 and a photoconductive layer 3. In facing relationship to said drum-shaped photosensitive member 1 there are provided a corona discharger 4 for charging said photosensitive member, a charge-eliminating grounded electrode 5 and a potential measuring device S. In the following there will be given an explanation of a case in which the photosensitive member 1 in the apparatus shown in FIG. 1 is shifted from a first speed to a second speed which is three times faster than said first speed. In this embodiment, in response to said shifting from the first speed to the second speed, the voltage supplied to the corona discharger 4 is regulated so as to triple the quantity of ions directed toward the photosensitive member 1 in order to maintain a constant potential on said photosensitive member 1 both in the first speed and the second speed. FIG. 2 shows the drum peripheral speed (v) and corona current (i) in ordinate, which are obtained in the apparatus shown in FIG. 1, as a function of time (T) in abscissa. When the peripheral speed of the photosensitive member 1 is switched at the time $T_0$, the photosensitive member reaches the triple speed after a certain start-up period. On the other hand, in order to achieve uniform charging under the thus tripled speed, the current from the corona discharger 4 to the photosensitive member 1 should likewise be tripled. However, if the current of said discharger 4 is tripled simultaneously with the speed change-over of said photosensitive member, the discharge becomes stabilized with a start-up time shorter than said start-up time of the photosensitive member, as represented by the chain line. Such start-up time of the photosensitive member tends to be longer than that of the high-voltage source unless the motor for driving the photosensitive member has an ample torque. In FIG. 2 there is shown a state in which the start-up time of the photosensitive member is almost ten times as long as that of the corona discharger.

FIG. 3 shows the change in the amount of charge received by the photosensitive member in the presence of the difference as explained above between the start-up times. Said amount of charge is proportional to the corona current toward said photosensitive member divided by the speed thereof, said amount being represented by the full line in FIG. 3. As shown in FIG. 3, the photosensitive member receives, at the speed change-over, a charge almost three times as large as that in the normal state. Such excessive charge on the photosensitive member cannot be smoothed for example by potential adjustment with a corona discharger in the succeeding steps and appears on the final image after image development of the photosensitive member. In order to prevent such excessive charging the start-up time of the corona discharger should be made to coincide with that of the photosensitive member. Thus, for realizing a uniform charging, it is required to extend the start-up time of the high-voltage source in synchronization with the start-up time of the photosensitive member. A forced extension of said start-up time will however require a large capacitor, and even with such method it is difficult to regulate the ending time of the corona discharger in synchronization with the deceleration of the photosensitive member.

The charging process of the present invention enables the prevention of the aforementioned excessive charging without such associated drawbacks as mentioned above, and it minimizes the unevenness in the charge through a simple charging control. More specifically, according to this process, a corona discharger with a short start-up time is put into function after the speed change-over of the photosensitive member.

It is now assumed in FIG. 2 that the peripheral speed of the photosensitive member is changed at the time $T_0$, and the charging is switched at the time $T_1$ as shown by the chain line. In such case, as shown by the chain line in FIG. 3, the amount of charge on the photosensitive member decreases hyperbolically after the time $T_0$ toward a value equal to one-third of the charge amount before the speed change-over, since the corona current does not change until the time $T_1$ while the speed of the photosensitive member has started to increase from the time $T_0$. The above-mentioned hyperbolic change is observed in case the peripheral speed of the photosensitive member increases linearly in time as shown in FIG. 2.

Upon a triple increase of the corona current at the time $T_1$, the amount of charge shows a change along the full-lined curve thereafter. Thus, around the time $T_1$ there are created areas which are respectively charged excessively and deficiently, but the extent of such excess and deficiency is significantly smaller than the excessive charge in the foregoing case not embodying the present invention.

In the following the present invention will be further clarified by an embodiment in which the present invention is applied to a copier employing a screen-shaped photosensitive member.

Figure 4:
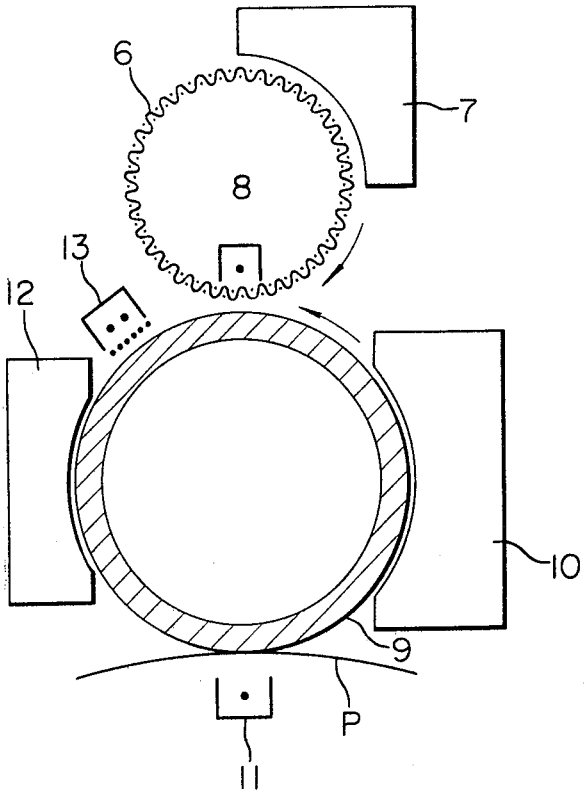
FIG. 4 is a schematic cross-sectional view of a copier embodying the present invention.

FIG. 4 shows said copier in a schematic cross-sectional view, in which a latent image is formed on a screen-shaped photosensitive member 6 (hereinafter simply referred to as screen) by means of primary latent image forming means 7 and is utilized for modulating the corona ions from a corona discharger 8 to an insulating drum 9, thereby forming a secondary latent image on said drum 9. Said screen is composed of a special photosensitive member provided with a plurality of small openings, and, as detailedly disclosed in the British Pat. No. 480,841 of the present applicant, is capable of producing plural secondary latent images from a single primary latent image.

Along the periphery of said insulating drum 9 there are provided developing means 10 for performing toner development of said secondary latent image, a transfer corona discharger 11, cleaning means 12 for removing the toner remaining on said drum and a charge eliminating corona discharger 13 for eliminating the remaining charge, while sheet materials P are supplied one by one from an unrepresented sheet stack to the image transfer station. Upon completion of image transfer under the function of said corona discharger 11, said sheet materials are separated from said drum 9, guided to fixing means and ejected from the apparatus.

In the above-explained apparatus said screen 6 is driven at a first peripheral speed of 14 cm/sec during the formation of said primary latent image in correlation with the displacing speed of the optical system and also in order to secure a sufficient corona discharge onto said screen, while it is driven at a second peripheral speed of 42 cm/sec, which is three times as fast as said first speed, during the modulation step by the discharger 8 as the primary latent image forming means is not in function in this state. Thus, although the corona discharger around the screen 6 is not used after the formation of the primary latent image, the dischargers around the insulating drum 9 have to be controlled so as to achieve necessary charging at the operation with said second speed and still so as not to generate abnormal potential on the insulating drum 9 even during the operation at said first speed.

In the apparatus shown in FIG. 4, the charge eliminating corona discharger 13, because of the presence of a control grid, does not result in a significant fluctuation in the charged potential even when the peripheral speed of the insulating drum 9 is changed from said first speed to said second speed, or vice versa. Consequently attention should be paid to the potential on the drum 9 caused by the transfer corona charger 11, which will be explained in detail in the following.

The insulating drum 9 is initially charged to a uniform potential of ca. +50 V by the charger 13, and, upon subsequent receipt of negative corona ions modulated imagewise by said screen, the image area of said drum is charged to a potential of ca. −150 V. The transfer corona discharger 11 is designed to have an intensity, in the absence of the transfer sheet P which is to be charged by said discharger, of changing the potential of said drum 9 from +50 V to −300 V. Also the discharger 13 has an ability of reducing a potential unevenness of ca. 100 V present on the insulating drum to an unevenness of ca. 5 V. The transfer corona discharger 11, receiving a potential of −4.7 V or −6.0 KV respectively at the low- or high-speed operation (14 or 42 cm/sec), generates an excessively charged area of −1000 V if the voltage is switched simultaneously with the speed change-over. Said excessively charged area showed a potential of +15 V after passing the charge eliminating corona discharger which is different by 35 V from the potential of 50 V in other areas. In this case the increase of the drum peripheral speed from the first speed to the second speed requires 0.3 seconds while the switching of the high-voltage source only requires 0.03 seconds. When the switching of said high-voltage source is delayed by 0.14 seconds according to the present invention from the change-over of the drum peripheral speed, the charge in the excessively charged area is reduced from −1000 V to −450 V. After passing the discharger 13 said area shows a potential of 43 V which is different only by 7 V from 50 V in other areas. In this manner the unevenness in potential is significantly reduced from the aforementioned fluctuation of 35 V.

It is to be noted that various modifications are possible in achieving the above-mentioned uniform potential. For example it is possible to turn off the transfer corona discharger during the operation at the higher second speed. Naturally also in such case there is required means for delaying the application of voltage to the transfer corona discharger or for delaying the increase of voltage at the change-over to the higher speed.

Furthermore the present invention is applicable also to the case in which the image holding member is changed from the high speed to the low speed. In such case the observed behaviors are as if the curves in FIGS. 2 and 3 are made upside down.

As explained in the foregoing, the present invention provides for charging the image holding member to an approximately constant potential by means of a simple process, thus assuring an improvement in the image quality.

What is claimed is:

1. A charging process for use in an image forming apparatus in which a charge is applied to an image holding member which is driven at a first speed and at a second speed different from said first speed for image formation, which comprises, upon shifting of said image holding member from said first speed to said second speed, controlling charging means which applies said charge to the image area of said image holding member in such a manner as to initiate or terminate the function of said charging means or to change the charging ability thereof after the start of said speed shifting of said image holding member.

2. A charging process for use in an image forming apparatus according to the claim 1, wherein said second speed is higher than said first speed.

3. A charging process for use in an image forming apparatus according to the claim 1, wherein said first speed is higher than said second speed.

4. A charging process for use in an image forming apparatus according to the claim 2 or 3, wherein said step of controlling charging means to initiate or terminate the function of said charging means or to change the charging ability of said charging means is achieved by changing the voltage or current supplied to said charging means.

5. A charging process for use in an image forming apparatus according to the claim 1, wherein said image holding member is a drum on which a latent image is formed and subsequently developed, and said charging means is a corona discharger for transferring a thus developed image onto another sheet material.

6. A charging process for use in an image forming apparatus in which a charge is applied to an image holding member which is driven at a first speed and at a second speed different from said first speed for image formation, which comprises, upon shifting of said image holding member from said first speed to said second speed, controlling charging means which applies said charge to the image area of said image holding member in such a manner as to initiate or terminate the function of said charging means or to change the charging ability thereof during said speed shifting of said image holding member from said first speed to said second speed.

* * * * *